US007666109B2

(12) United States Patent
White

(10) Patent No.: US 7,666,109 B2
(45) Date of Patent: Feb. 23, 2010

(54) INTEGRATED POLE PAD FOR SPORTS SUPPORT POLE

(75) Inventor: Ronald A. White, North Prairie, WI (US)

(73) Assignee: Russell Brands, LLC, Alexander City, AL (US)

( * ) Notice: Subject to any disclaimer, the term of this patent is extended or adjusted under 35 U.S.C. 154(b) by 217 days.

(21) Appl. No.: 11/907,966

(22) Filed: Oct. 18, 2007

(65) Prior Publication Data

US 2009/0105016 A1 Apr. 23, 2009

(51) Int. Cl.
*A63B 63/08* (2006.01)

(52) U.S. Cl. ..... 473/483; 473/478; 473/479

(58) Field of Classification Search ..... 473/483, 473/479, 473, 465; 273/400; 267/116; D21/699
See application file for complete search history.

(56) References Cited

U.S. PATENT DOCUMENTS

| | | | | | |
|---|---|---|---|---|---|
| 3,782,724 | A | * | 1/1974 | Rottman et al. | 267/140 |
| 3,831,941 | A | * | 8/1974 | Pease | 267/116 |
| 4,653,646 | A | | 3/1987 | Allen | |
| 4,867,135 | A | * | 9/1989 | Stecker | 126/500 |
| 5,090,837 | A | | 2/1992 | Mower | |
| 5,118,162 | A | * | 6/1992 | Saul | 297/219.1 |
| 5,248,140 | A | | 9/1993 | Matherne et al. | |
| 5,354,049 | A | | 10/1994 | Matherne et al. | |
| 5,375,835 | A | | 12/1994 | Van Nimwegen et al. | |
| 5,524,882 | A | * | 6/1996 | Wagner | 473/477 |
| 5,573,237 | A | | 11/1996 | Van Nimwegen et al. | |
| 5,632,480 | A | | 5/1997 | Davis et al. | |
| 5,839,714 | A | | 11/1998 | Fitzsimmons et al. | |
| 5,902,197 | A | | 5/1999 | Davis et al. | |
| 6,001,034 | A | | 12/1999 | Schickert et al. | |
| 6,041,559 | A | | 3/2000 | Schckert et al. | |
| 6,120,396 | A | | 9/2000 | Van Nimwegen et al. | |
| 6,135,901 | A | | 10/2000 | Van Nimwegen | |
| 6,155,938 | A | | 12/2000 | Mower | |
| 6,283,878 | B1 | | 9/2001 | White | |
| 6,419,597 | B1 | | 7/2002 | Van Nimwegen et al. | |
| 6,645,095 | B1 | | 11/2003 | Nye et al. | |
| D529,558 | S | | 10/2006 | White | |
| 7,150,690 | B1 | * | 12/2006 | Cusick | 473/478 |
| 7,300,059 | B2 | * | 11/2007 | Caruso | 273/400 |
| 2002/0094890 | A1 | | 7/2002 | White et al. | |
| 2007/0178994 | A1 | | 8/2007 | White et al. | |
| 2009/0105016 | A1 | * | 4/2009 | White | 473/483 |

* cited by examiner

*Primary Examiner*—Gene Kim
*Assistant Examiner*—M Chambers

(57) ABSTRACT

The present invention is a sports support structure with an integrated pad. By ensuring that the protective pad is integrated with the structure, the present invention ensures theft padding is properly located around the support structure. The integrated pad and sports structure may be raised and lowered to a desired height with a handle attached to an elevator mechanism.

10 Claims, 21 Drawing Sheets

INTEGRATED POLE PAD FOR SPORTS SUPPORT POLE

FIELD OF THE INVENTION

The present invention relates to a pad for use with a sports support pole. More specifically, the present invention relates to a pad which may be integrated into a sports support pole and which remains in place during game play.

BACKGROUND OF THE INVENTION

When traveling through most neighborhoods, one can typically find a freestanding basketball backboard/hoop assembly on playgrounds or residential driveways and play areas. These basketball backboard/hoop assemblies are generally attached to a support pole anchored in, or attached to the ground on or near the basketball play area. In order to sufficiently support the backboard and hoop, these support poles are usually constructed from a hard material, such as steel or aluminum.

However, the support pole may be potentially dangerous to individuals playing basketball or engaging in other activities in the play area. For example, players in a basketball game may be accidentally pushed into or collide with the pole during gameplay. Because of the way a support pole may be shaped and because support poles may be constructed from a hard material, collisions with the pole may cause injury. As such, it is desirable to provide protection to those individuals playing basketball or engaging in other activities near a support poll so as to minimize the effect of collisions with the pole.

One prior attempt at providing such protection has been to enclose the support pole with an after-market pad which may be wrapped around the pole. Typically, this padding is constructed by encasing foam with a vinyl cover and may be wrapped around the pole after the basketball assembly is erected. The padding is generally wrapped around the pole and fastened to itself using a hook and loop or lacing closure or other means known in the art.

The prior pads, however, suffer from many drawbacks. For example, because the pads are wrapped around the pole, they may be prone to movement when the pad is hit aggressively. This may result in the pad being repositioned in a manner which does not provide maximum protection against collisions. Further, the materials used to construct the pads are susceptible to wear and tear and weathering and must be either stored when not being used or must be replaced periodically. Finally, because the pads are generally purchased separately from the support pole, they are often not "custom" fit for the support pole and, as a result, may not properly fit the support pole. Moreover, pads that do not precisely fit the support pole may shift, slip, or slide during usage. This can lead not only to poor appearance, but also to the pad providing insufficient or inefficient protection. Additionally, pads purchased separately from a support pole may wrap around the outside of the support pole and not be able to adjust or fit properly on a basketball pole that telescopes up and down.

Therefore, what is needed is a durable pad for a support pole which remains firmly in place, and which is formed to fit the support pole with which it is being used.

SUMMARY OF THE INVENTION

The present invention relates to a pad for attachment to a sports support pole. More specifically, the present invention relates to a pad which may be integrated into a sports support pole and which remains in place during game play.

One embodiment of the present invention relates to a basketball assembly. The basketball assembly may comprise a backboard and goal; a support pole having an exterior surface, a first end and a second end, the first end being attached to said backboard and goal; at least one pad attachment having a first and second surface, said at least one pad attachment being coupled to at least a portion of said support pole, such that a portion of the exterior surface of said support pole and a portion of the first surface of said at least one pad attachment form a substantially smooth and continuous exterior surface.

One embodiment of the present invention relates to a sports support assembly. The sports assembly may comprise a support pole having an exterior surface, a first end and a second end, the first end being attached to said backboard and goal; at least one pad attachment having a first and second surface, said at least one pad attachment being coupled to at least a portion of said support pole, such that a portion of the exterior surface of said support pole and a portion of the first surface of said at least one pad attachment form a substantially smooth and continuous exterior surface.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the figures, wherein:

DETAILED DESCRIPTION OF THE INVENTION

The present disclosure will now be described more fully with reference to the figures in which various embodiments of the present invention are shown. The subject matter of this disclosure may, however, be embodied in many different forms and should not be construed as being limited to the embodiments set forth herein.

Figure 1:
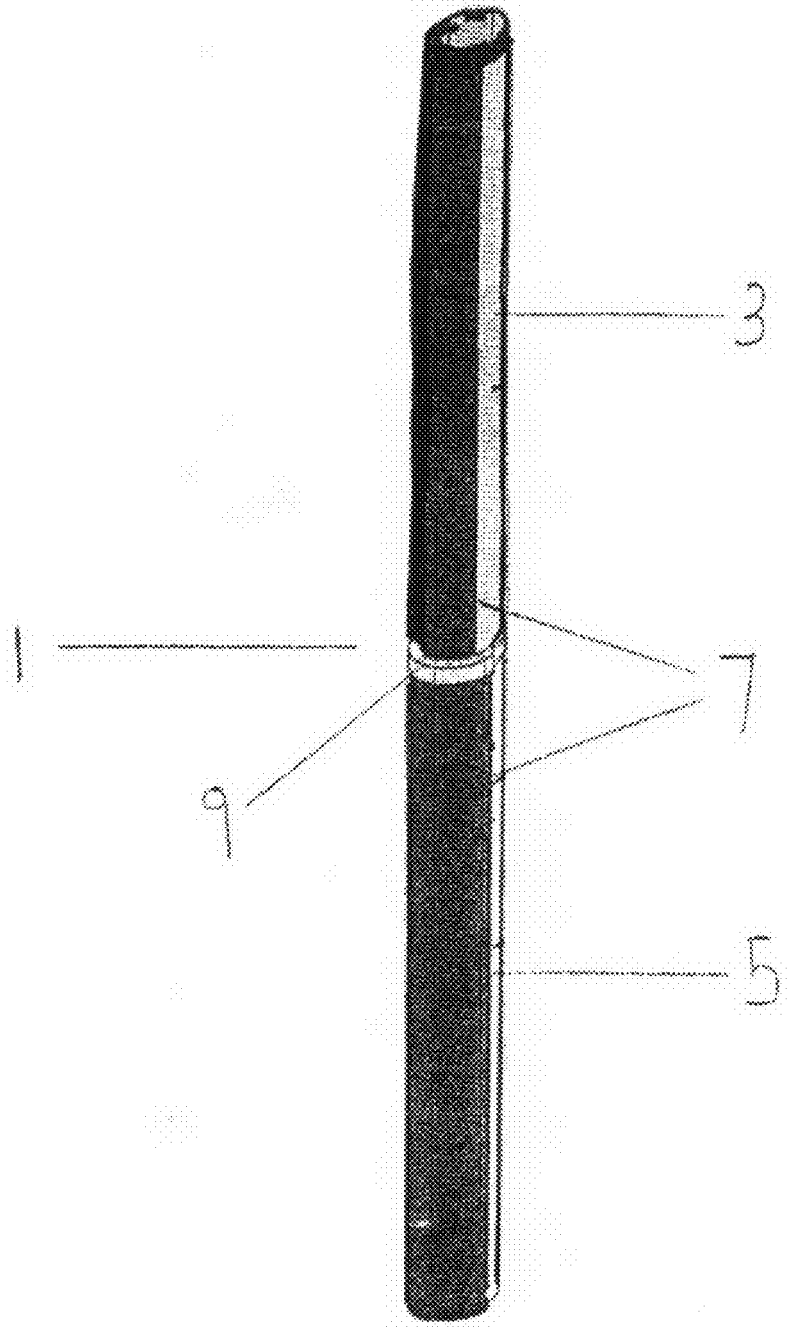
FIG. 1 shows an embodiment of the present invention with two tube member components.
Figure 2:
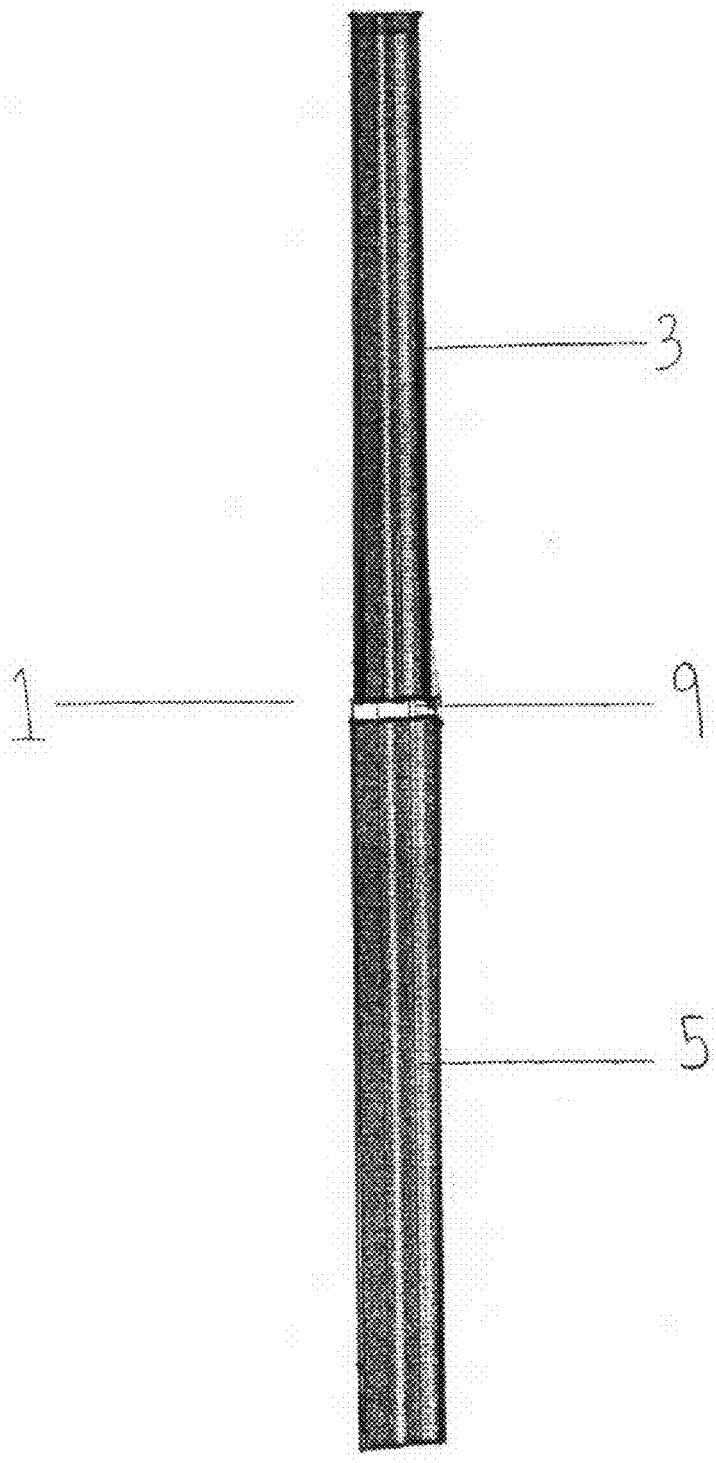
FIG. 2 shows a side-view of an embodiment of the present invention.
Figure 3:
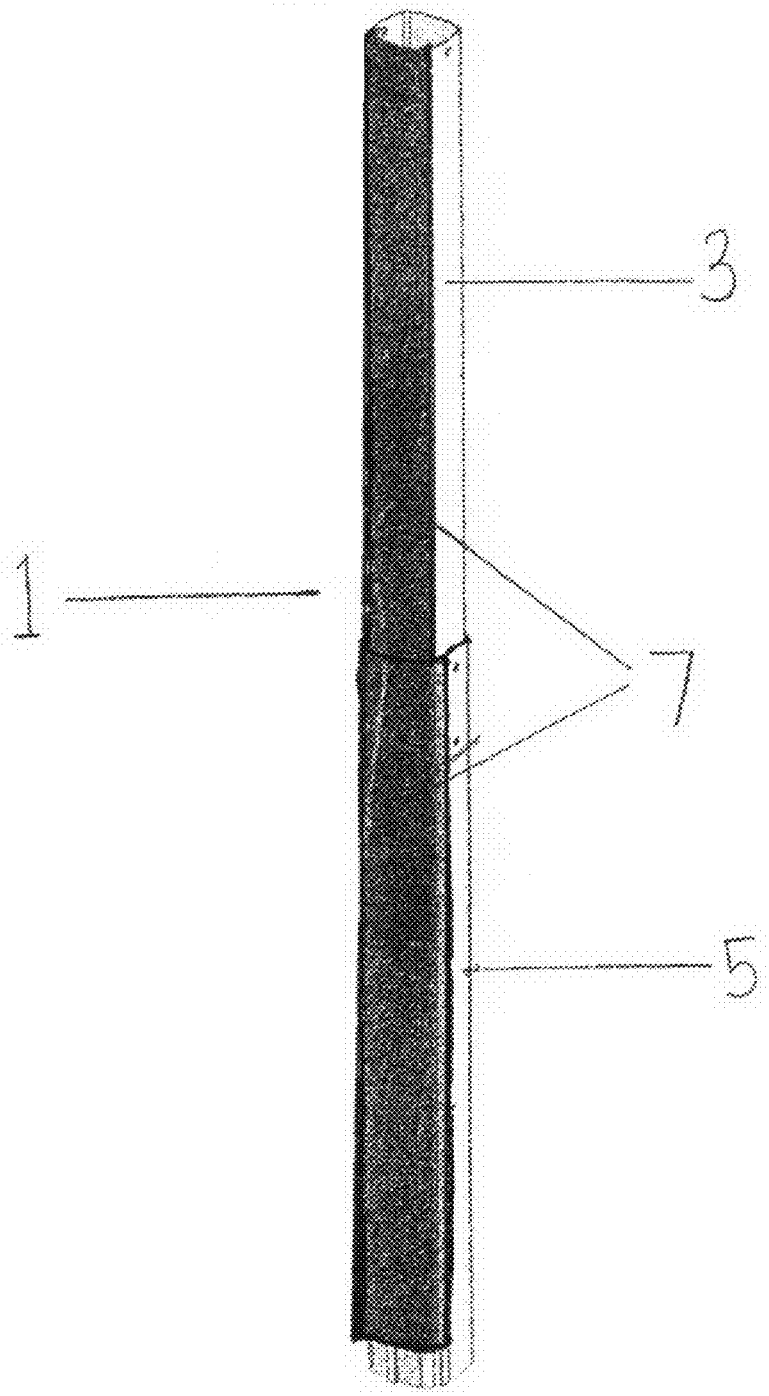
FIG. 3 shows an angled-view of an embodiment of the present invention.
Figure 4:
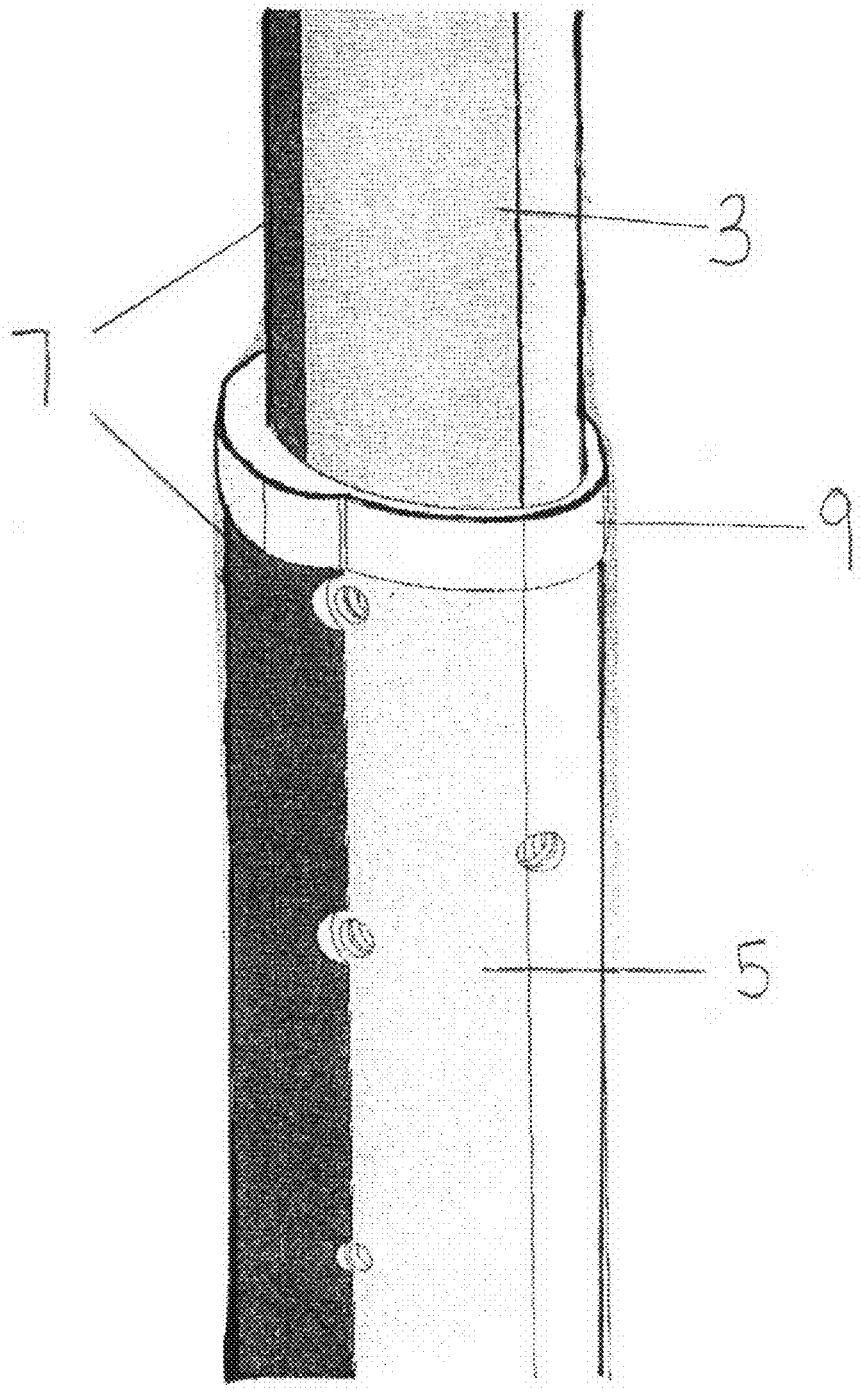
FIG. 4 shows two tube members and a tube jacket of an embodiment of the present invention.
Figure 5:
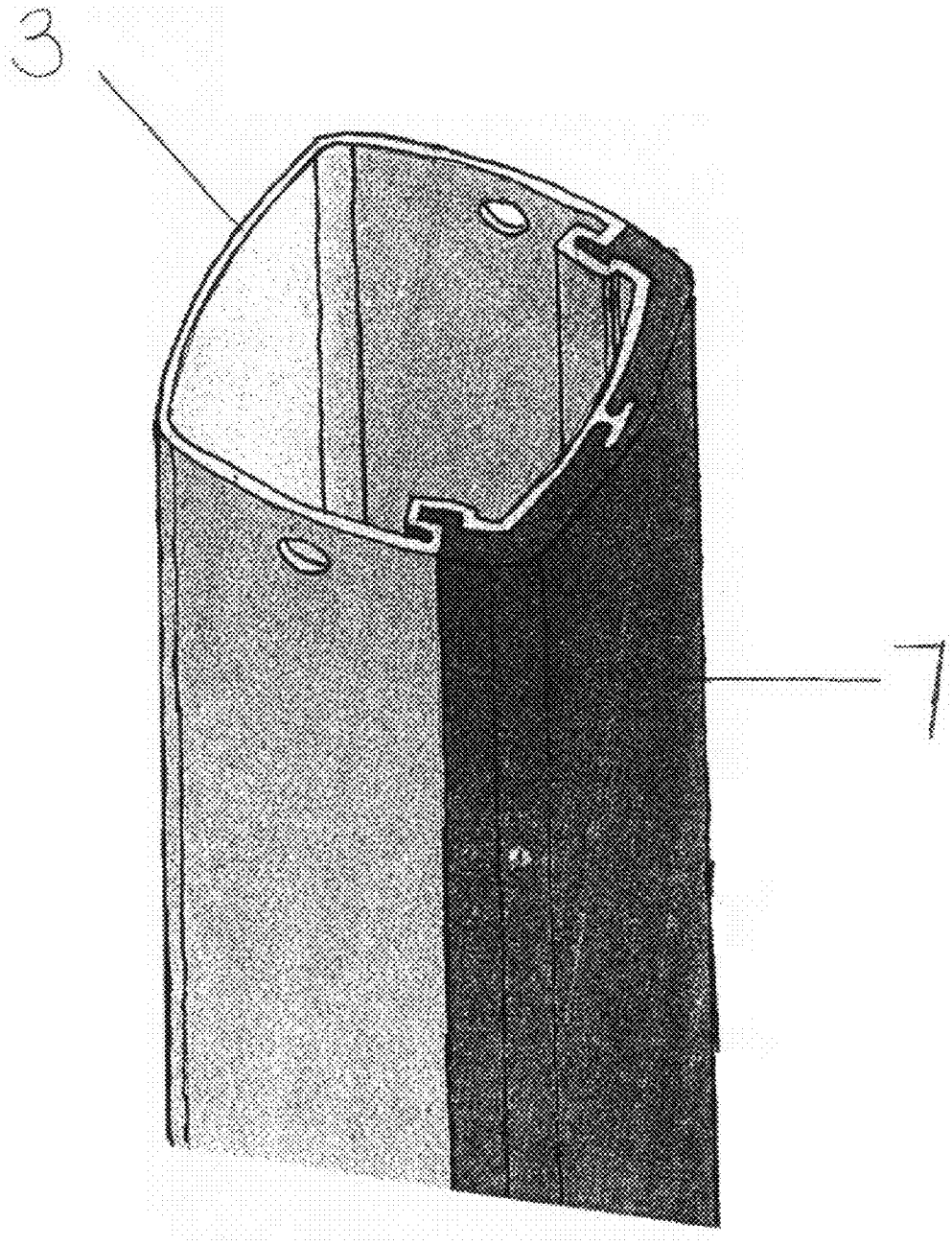
FIG. 5 shows an angled-view of a tube member component of an embodiment of the present invention.
Figure 19:
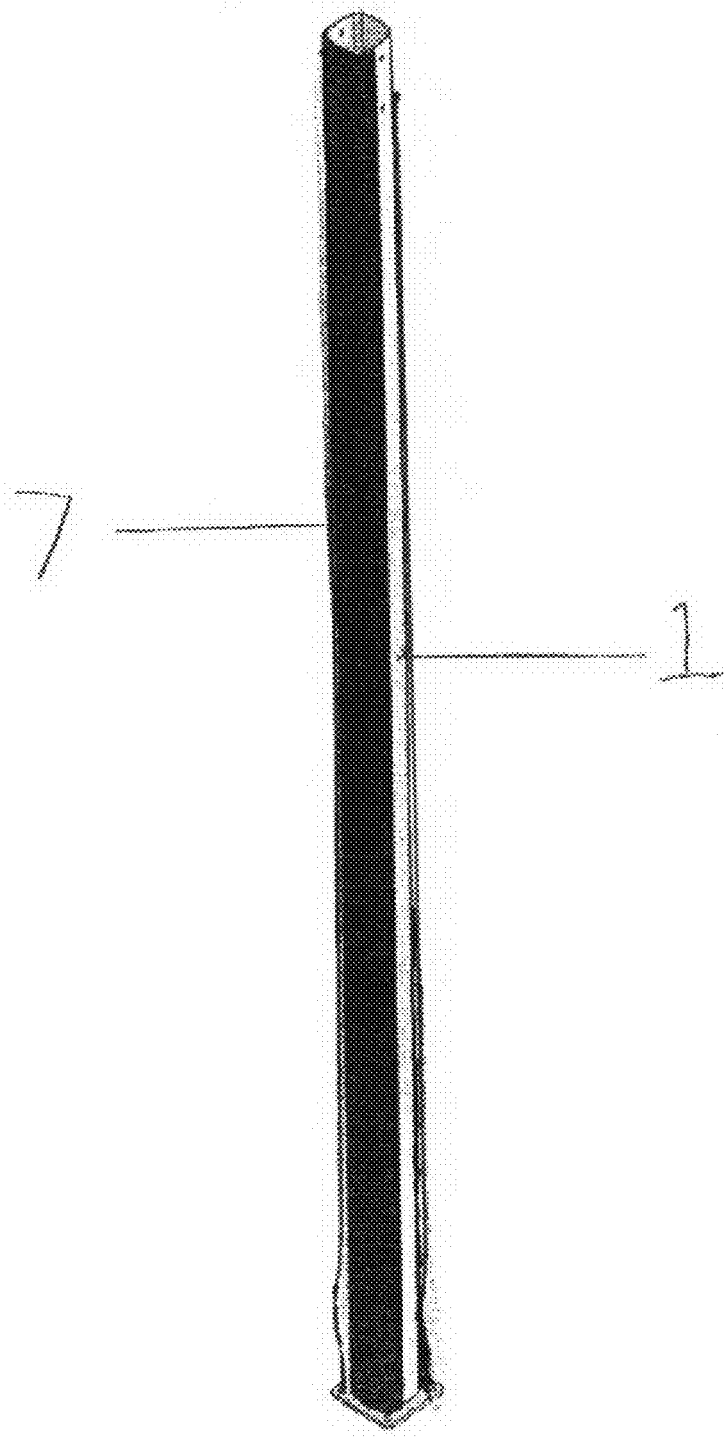
FIG. 19 shows an embodiment of the present invention with a single-piece tube member.

FIGS. 1, 2 and 3 show embodiments of the present invention. As can be seen from the figures, the present invention may comprise a main tube member 1. Main tube member 1 may have an exterior and interior surface. As can also be seen from the figures, in some, embodiments, the main tube member may comprise multiple tube member components (e.g., tube member components 3 and 5) which maybe connected to each other. Tube member components may have varying lengths and diameters. In some embodiments, one or more tube member components may be constructed so as to fit inside another tube member component, which has a slightly larger diameter. In this way, the present invention may be easier to handle as, when not in use, it may be compacted by sliding smaller-diameter tubes inside of larger ones (e.g., sliding tube member 3 into tube member 5). FIG. 4 shows a close-up of the connection of tube member components 3 and 5 in such a telescoping arrangement. FIG. 5 shows a close-up angled-view of a tube member component. In some embodiments, main tube member 1 may be a single piece or tube, as in the embodiment shown in FIG. 19.

As can also be seen in the figures, attached to the tube member components of the main tube member is padding member 7. Padding member 7 is made of padding or cushioning material to soften or cushion the impact of someone who may strike the main tube member. Padding member 7 may have 2 or more surfaces. The pad is preferably made of open or closed cell foam. The pad may also be made of urethanes, or injection molded or extruded plastics. Foam and plastic may be used on the pad for protective and decorative applications.

While shown in FIG. 1, as covering one half of the main tube member, in other embodiments, padding member 7 may cover a tube member entirely. In yet other embodiments, such as those shown in FIGS. 3 and 5, padding member 7 may cover only those portions of a tube member which a player using the present invention is most likely to collide with. FIGS. 1, 2, and 4 also show tube jacket 9. Tube jacket 9 may fit atop a tube member component and may be sized to correlate to the diameter of the tube member component. In some embodiments, where the tube members are coupled in a telescoping configuration or arrangement, tube jacket 9 may serve to guide one tube member component into another, as well as to protect tube members from damage as they are moved within one another. Tube jacket 9 may also protect an individual or user from colliding with the support pole by covering sharp or hard edges where tube member components meet.

Padding member 7 may be attached to a tube member during the manufacturing or installation of the support pole. As discussed in detail below, padding member 7 may be attached so that padding member 7 and the tube member it is attached to form a single, integrated piece. Padding member 7 and a tube member may be integrated into a single piece by attaching padding member 7 permanently or semi-permanently, so that it is not easily removeable and so that a tube member component and its attached padding member move as one, as in the telescoping embodiment of the present invention (discussed above).

Due to their bulky nature, the packaging and transportation of sports support structures and their associated accessories is often expensive and inconvenient. By adding padding member 7 during manufacturing one may be able to more compactly package and ship the present invention. In a telescoping embodiment of the present invention, tube member components may be stored and transported within one another, also enabling one to more compactly package and ship the present invention. Both result in cheaper, more convenient shipping, transportation, and storage. Furthermore, by adding padding member 7 during manufacturing, a consumer is saved the trouble of separately purchasing an after-market pad for a sports support pole. Costs are also reduced by saving a manufacture the separate shipping costs and space of separately manufacturing, transporting, and selling a sports support pole and an after-market pad for that support pole.

Figure 6:
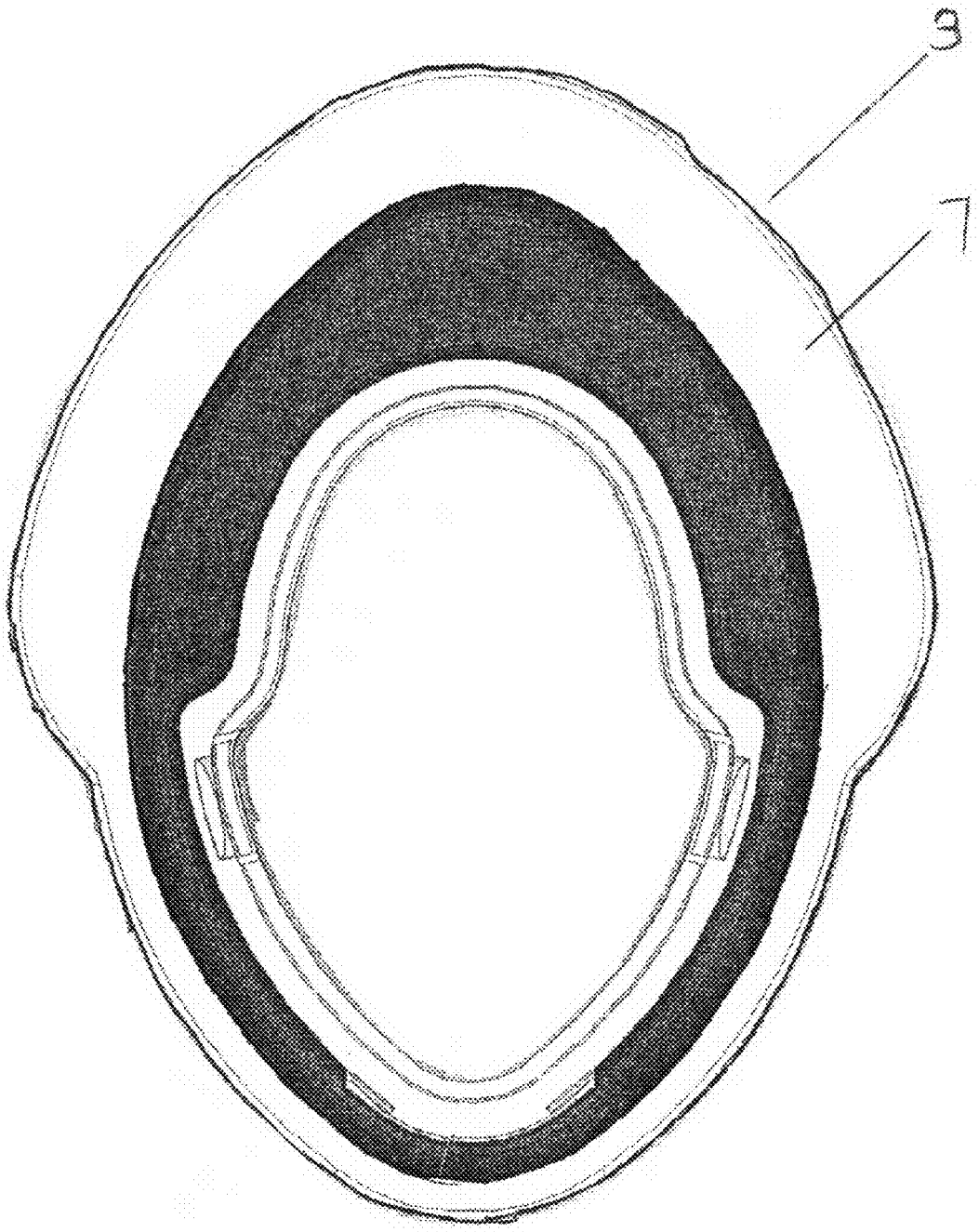
FIG. 6 depicts a cross-section of a tube member component.

FIG. 6 shows an exemplary cross section of tube member component 3. As can be seen in this figure, padding member 7 may have varying thickness depending upon the likelihood of a player colliding with a particular area of the padding member. Although depicted in FIG. 6 as a tube with an oval cross-section, it should be pointed out that the main tube member and its tube member components may be comprised of any elongated tube having any suitable cross-sectioned shape. For example, the cross-section of the main tube member and its tube member components may be oval, circular, square, rectangular, triangular, hexagonal, or any shape suitable for a basketball hoop support (see, e.g., FIG. 8). It should be noted that in some embodiments, the tube member is designed and manufactured with a specific curvature which may help protect someone colliding with it.

Figure 7:
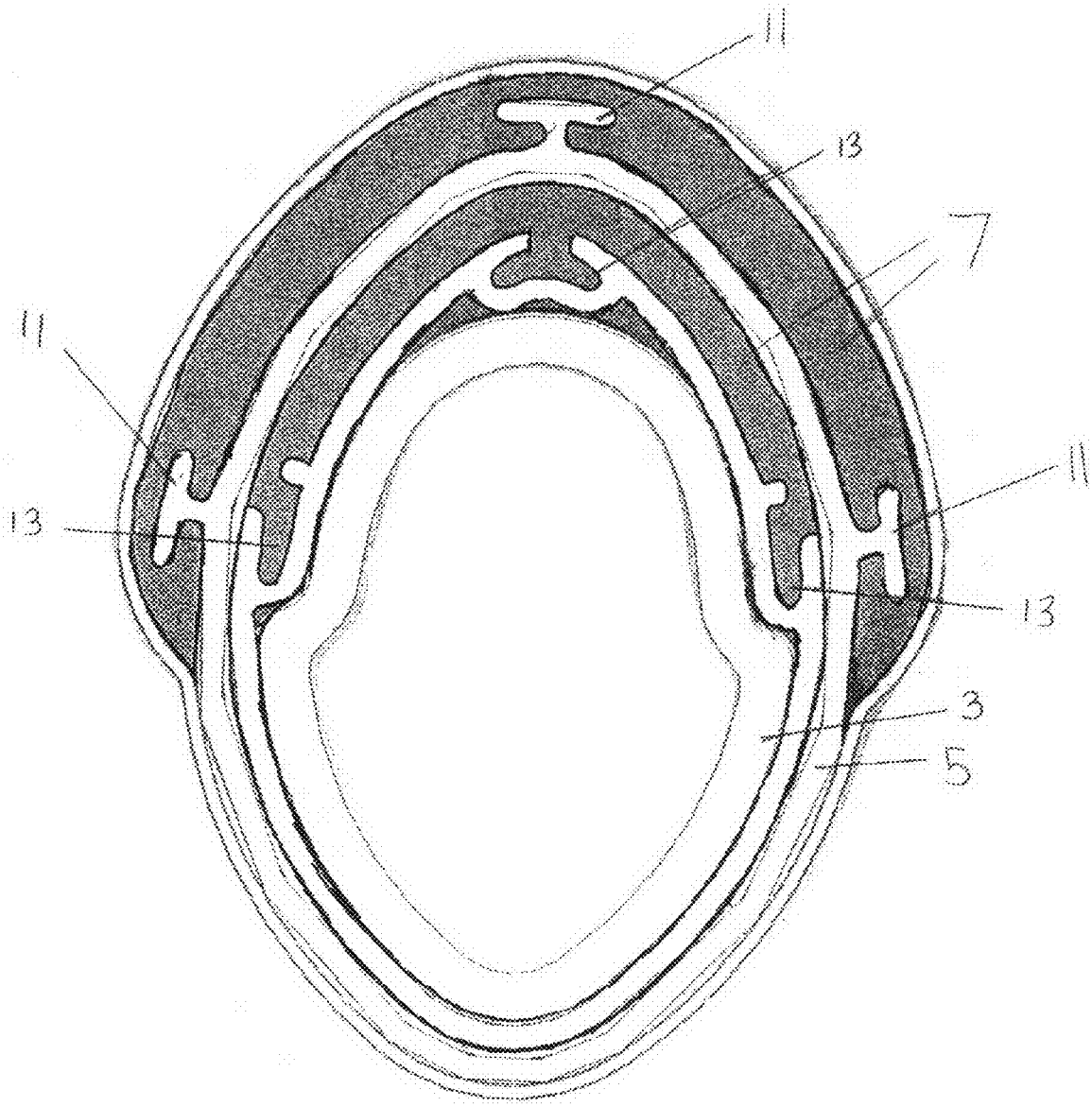
FIG. 7 depicts a cross-section of a tube member component within another tube member component.
Figure 8:
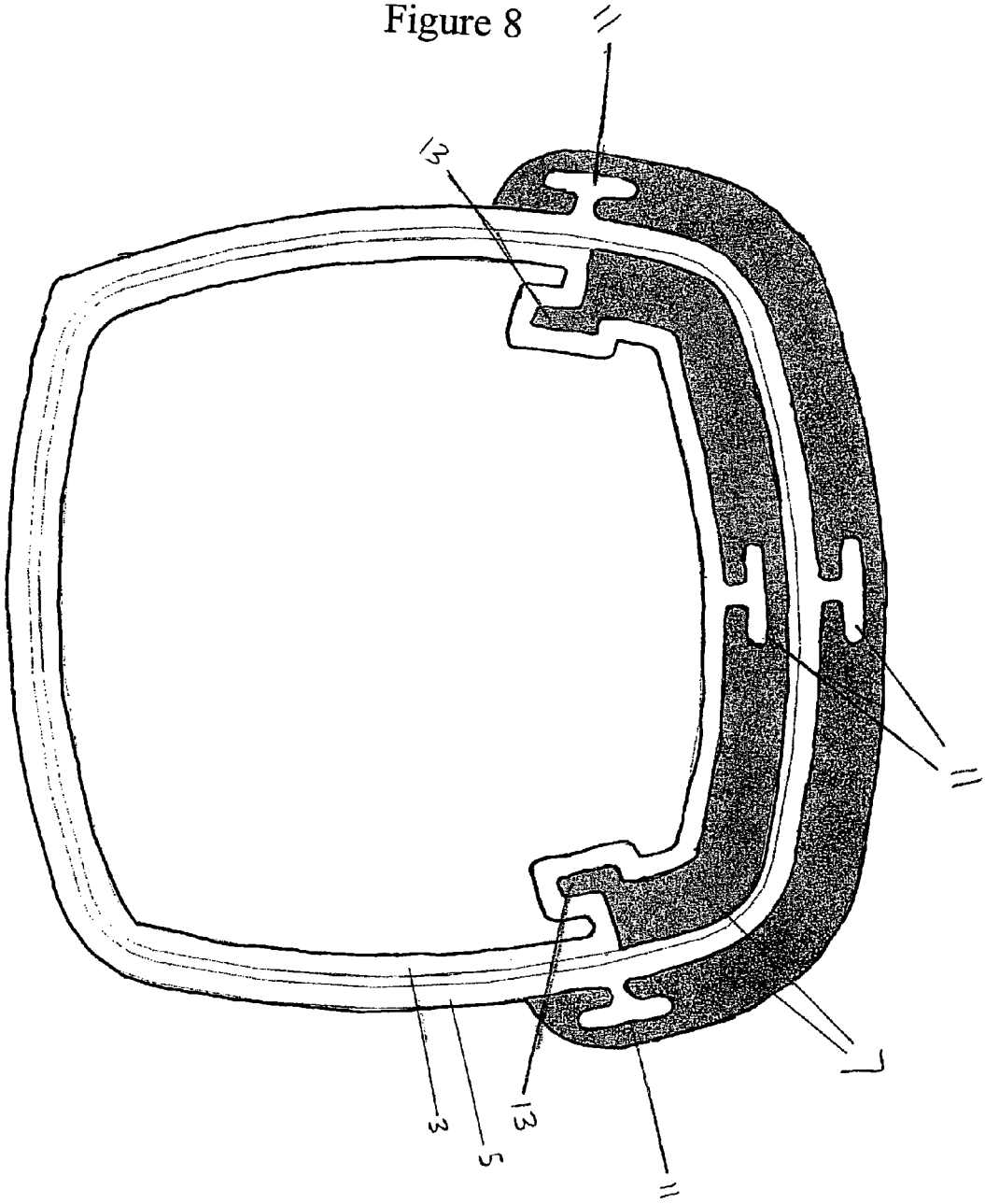
FIG. 8 depicts a cross-section of a tube member component within another tube member component.

FIGS. 7 and 8 show exemplary cross sections of tube member components 3 and 5, with tube member component 3 coupled in a telescoping arrangement inside of tube member component 5. As can be seen from these figures, padding member 7 may be attached to tube member components individually. Moreover, it should be noted that tube member component 3 may fit inside of tube member component 5 without the removal of padding member 7.

Padding member 7 may be attached to the main tube member or the tube member components by a variety of means and methods. Padding member 7 may be attached using a fastener means. The fastener means may comprise at least one tab and at one slot. The tab may comprise at least one locking tip while the at least one slot may be configured with an opening or slot to receive one or more tabs. As an example, FIGS. 7 and 8 show padding member 7 connected through padding attachment tabs 11. This method of attachment may be achieved by forming tabs on the body of the main tube member or tube member component. Slots configured to securely affix padding member 7 to the tube member are then cut or molded into padding member 7. By inserting the attachment tabs into the padding member slots, padding member 7 may be securely attached to the tube member. It should be noted that the attachment tabs may themselves be attached to the main tube member or tube member component or may be integrally formed with a tube member.

As another example, FIGS. 7 and 8 also show padding member 7 connected to a tube member component via padding insertion tabs 13. Padding insertion tabs are portions of padding member 7 shaped to be received into slots on a tube member. By placing insertion tabs within slots on the tube member, padding member 7 may be securely affixed to the tube member. It is important to note that, insertion tabs may be formed integrally with padding member 7 or may themselves be attached to the padding member. Likewise, slots may themselves be attached to the tube member or may be integrally formed with the tube member. It is important to note that padding member 7 may be attached by a variety of means not shown in the figures, such as adhesive means, nut and bolt attachments, screws, and other common attachment means known in the art. In some embodiments, attachment or padding insertion tabs may run the length of the tube member or pad. In some embodiments, attachment or padding insertion tabs may be placed at various intervals on the padding member or tube member. Likewise, in some embodiments, padding member 7 may be slid onto a tube member. In some embodiments, padding member 7 may be attached to a tube member by pressing the padding member onto the tube member, engaging the padding or attachment tabs.

It is important to note that the present invention, while described as supporting a basketball goal, may also be used to support other sports equipment and even non-sports related structures and apparatuses. Examples include, but are not limited to, volley ball and badminton nets, tether balls, and use as a support for a pole vaulting bar.

Figure 9:
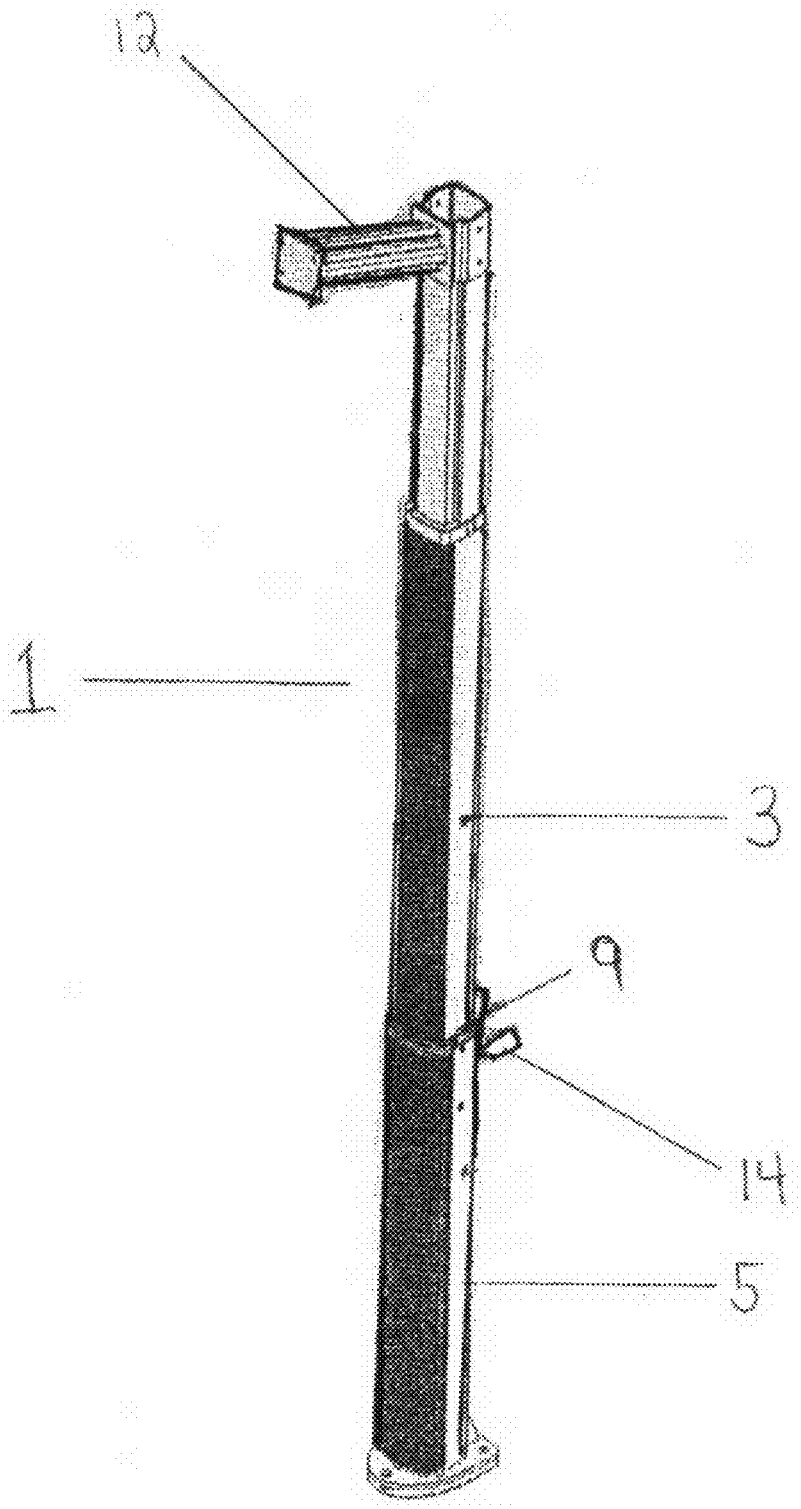
FIG. 9 shows an embodiment of the present invention with a basketball hoop bracket and a handle for an elevator mechanism.
Figure 10:
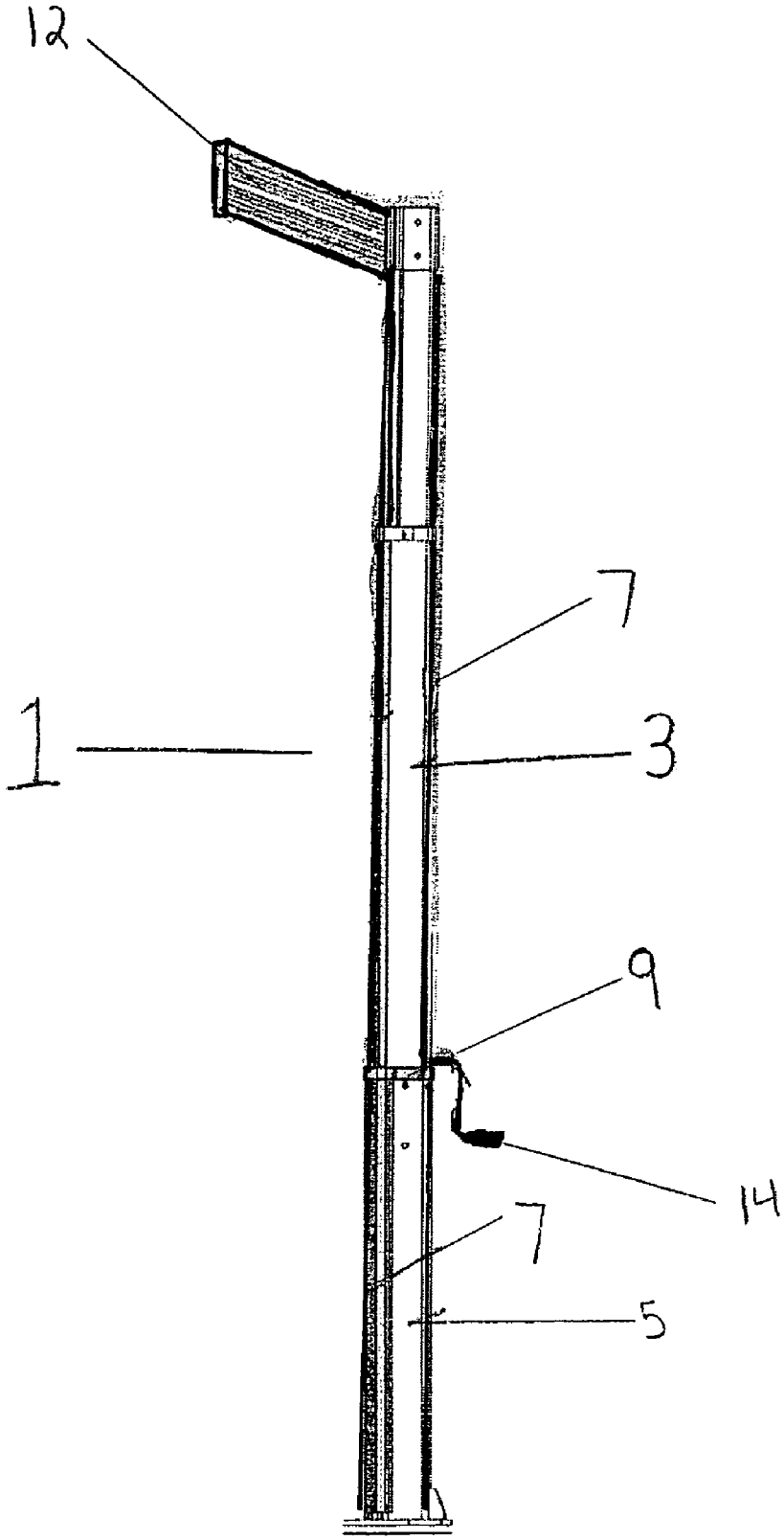
FIG. 10 shows a side-view of an embodiment of the present invention with a basketball hoop bracket and a hangle for an elevator mechanism.
Figure 11:
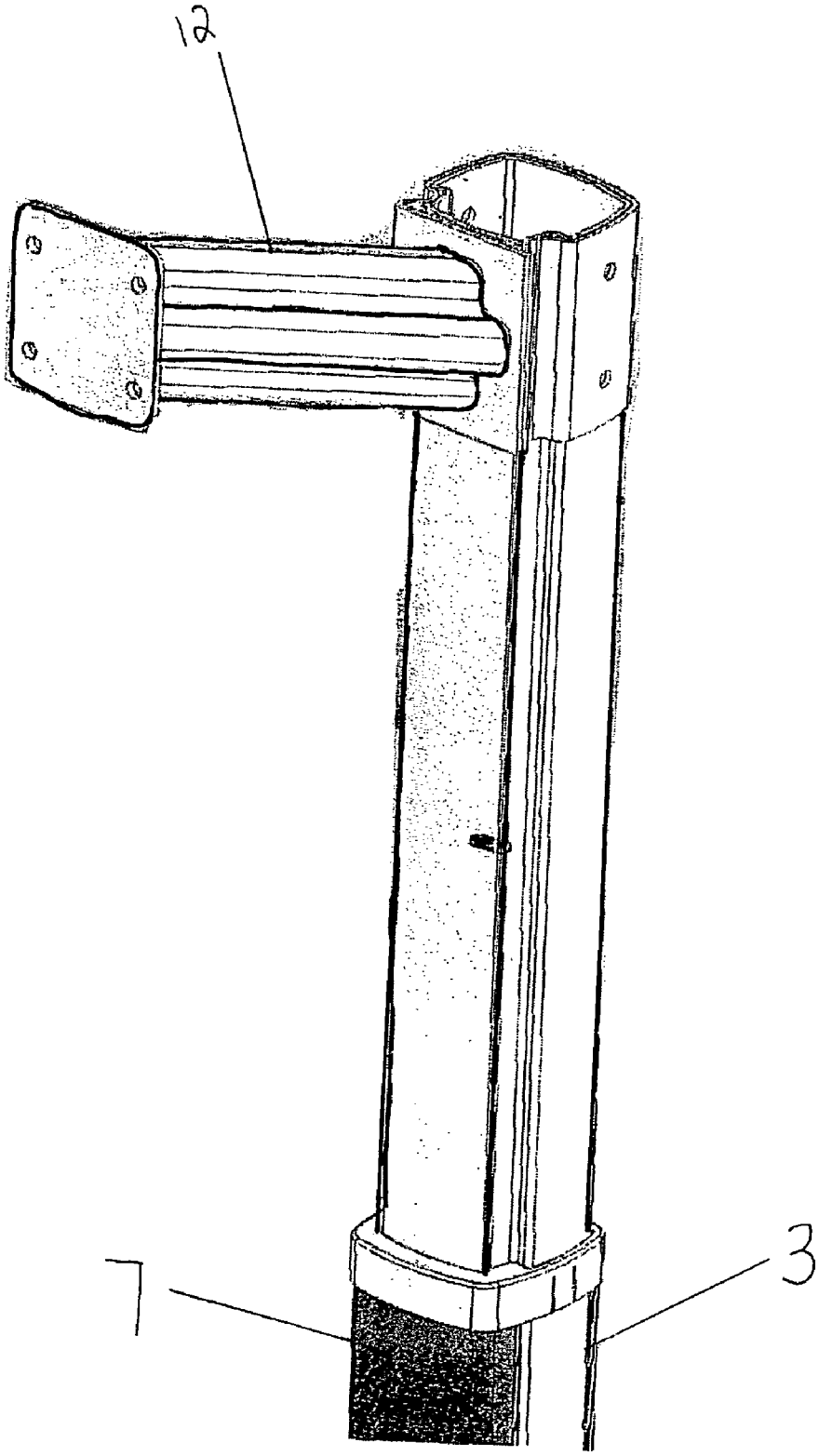
FIG. 11 shows a view of a basketball hoop bracket in an embodiment of the present invention.

FIGS. 9 and 10 show embodiments of the present invention. As can be seen in these figures, main tube member 1 may consist of multiple tube member components, coupled together in a telescoping arrangement. Hoop bracket 11 may be attached to the top of main tube member 1. FIG. 11 shows a close-up of a hoop bracket 11 in one embodiment of the present invention. A basketball hoop and backboard assembly (not shown) may be attached to hoop bracket 11. Also shown in FIGS. 9 and 10 is handle 13. Handle 13 may operate an elevator mechanism; by rotating handle 13, a user may activate the elevator mechanism, which may extend the main tube member by raising tube member components.

Figure 12:
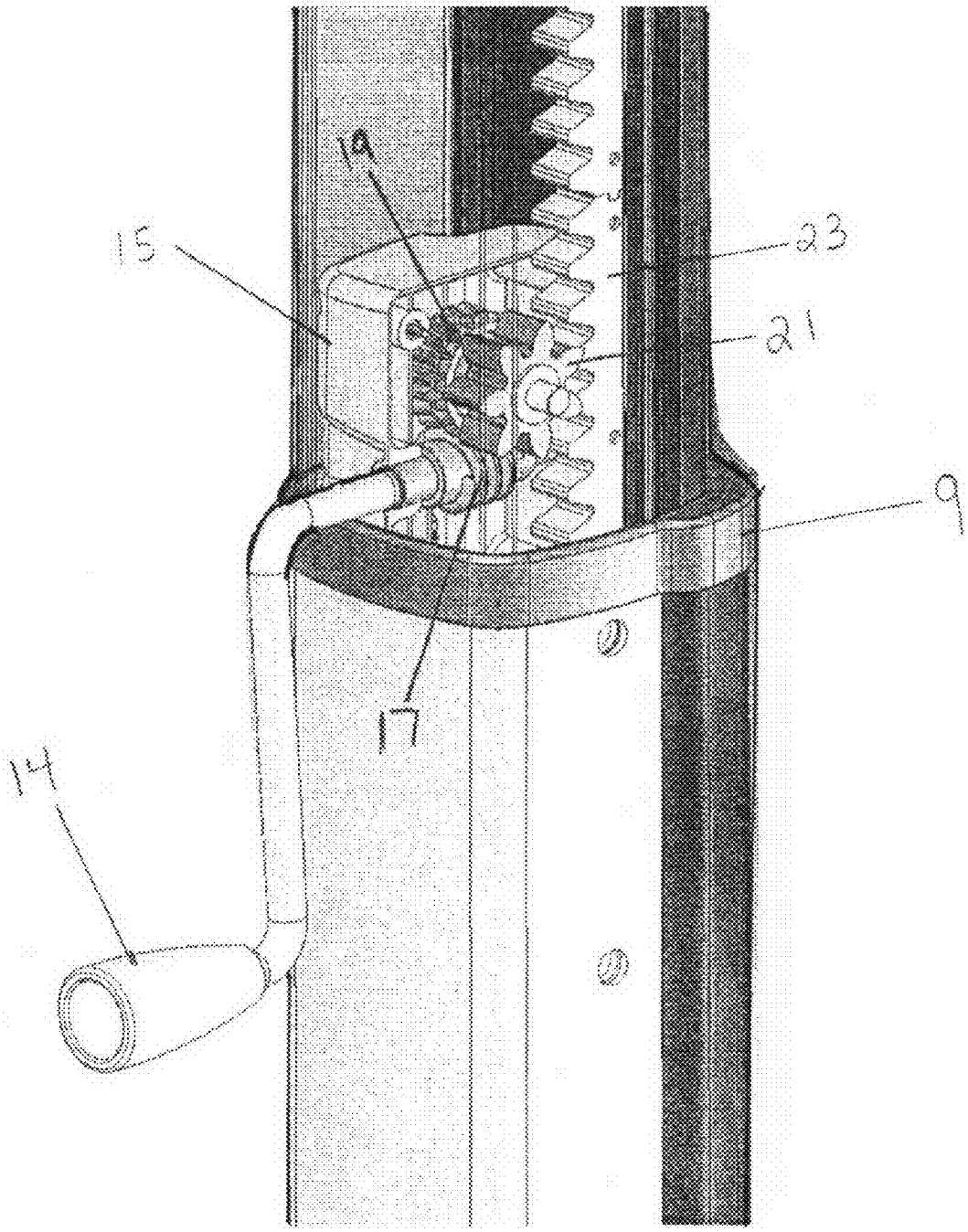
FIG. 12 shows an embodiment of the present invention with an elevator mechanism.
Figure 13:
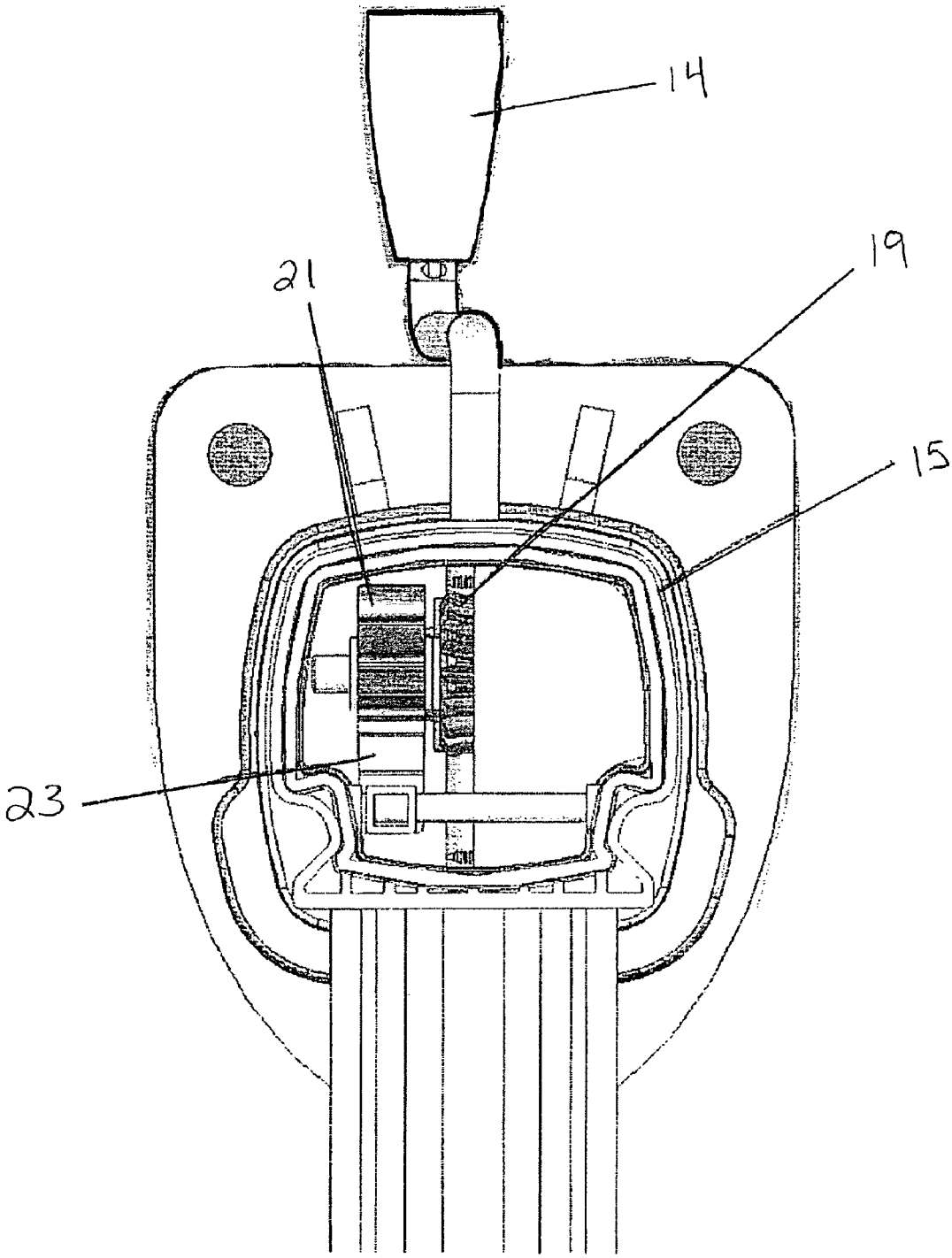
FIG. 13 shows a top-down view of an embodiment of the present invention with an elevator mechanism.
Figure 14:
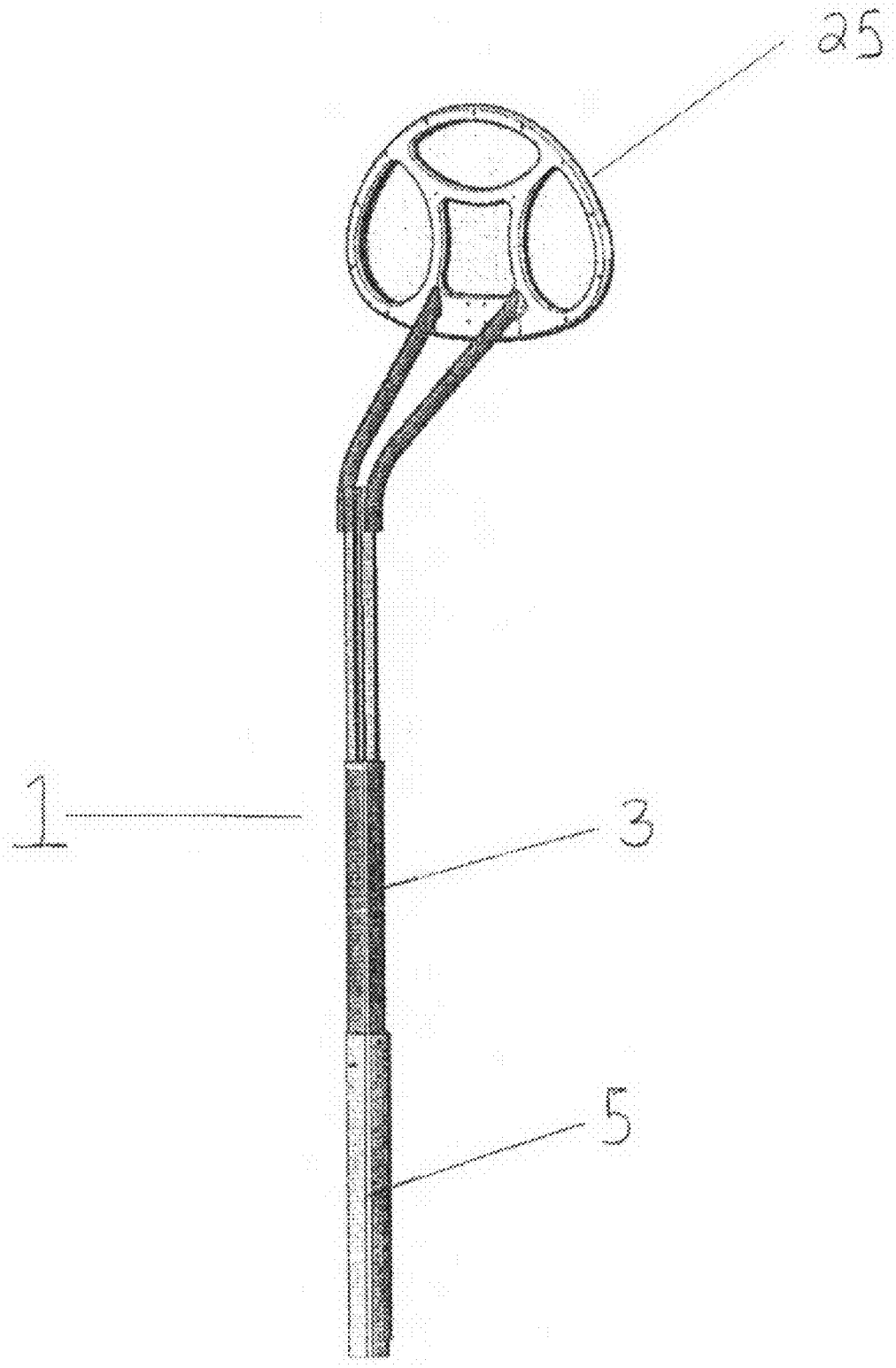
FIG. 14 shows an embodiment of the present invention with a basketball backboard.
Figure 15:
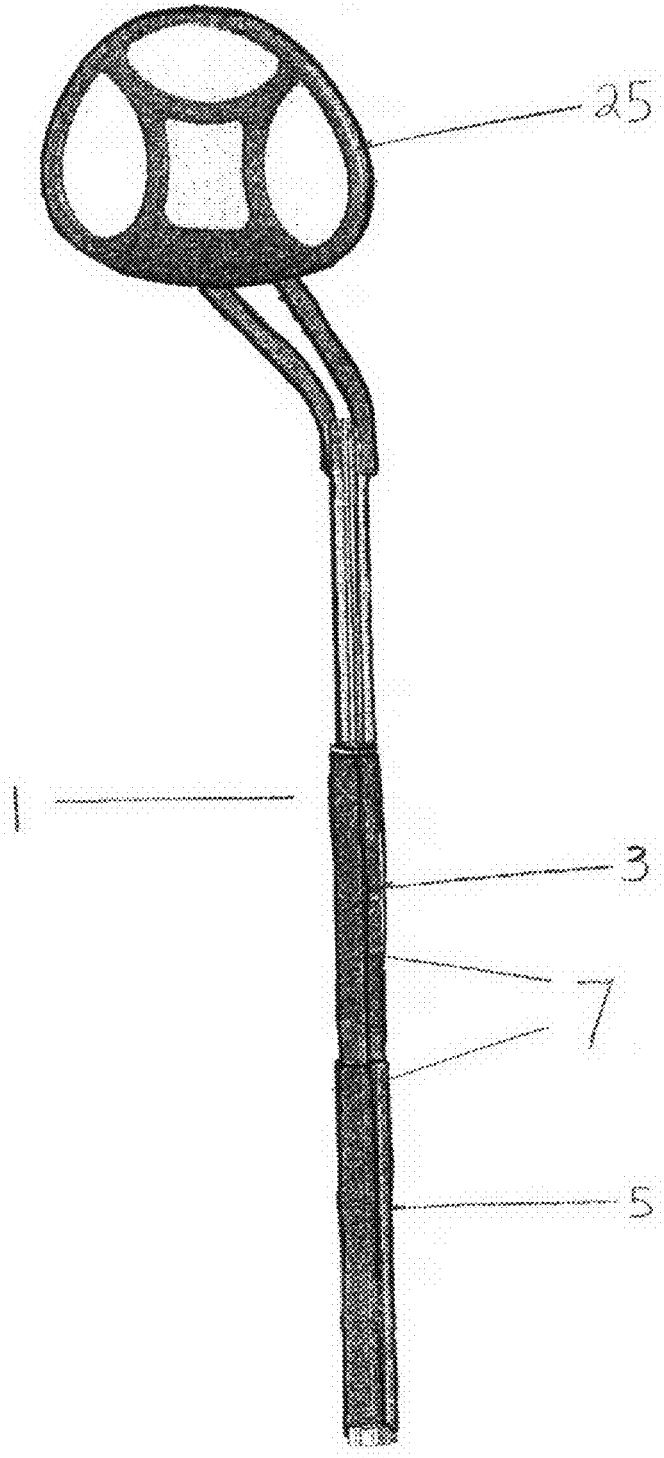
FIG. 15 shows an angled-view of an embodiment of the present invention with a basketball backboard.
Figure 16:
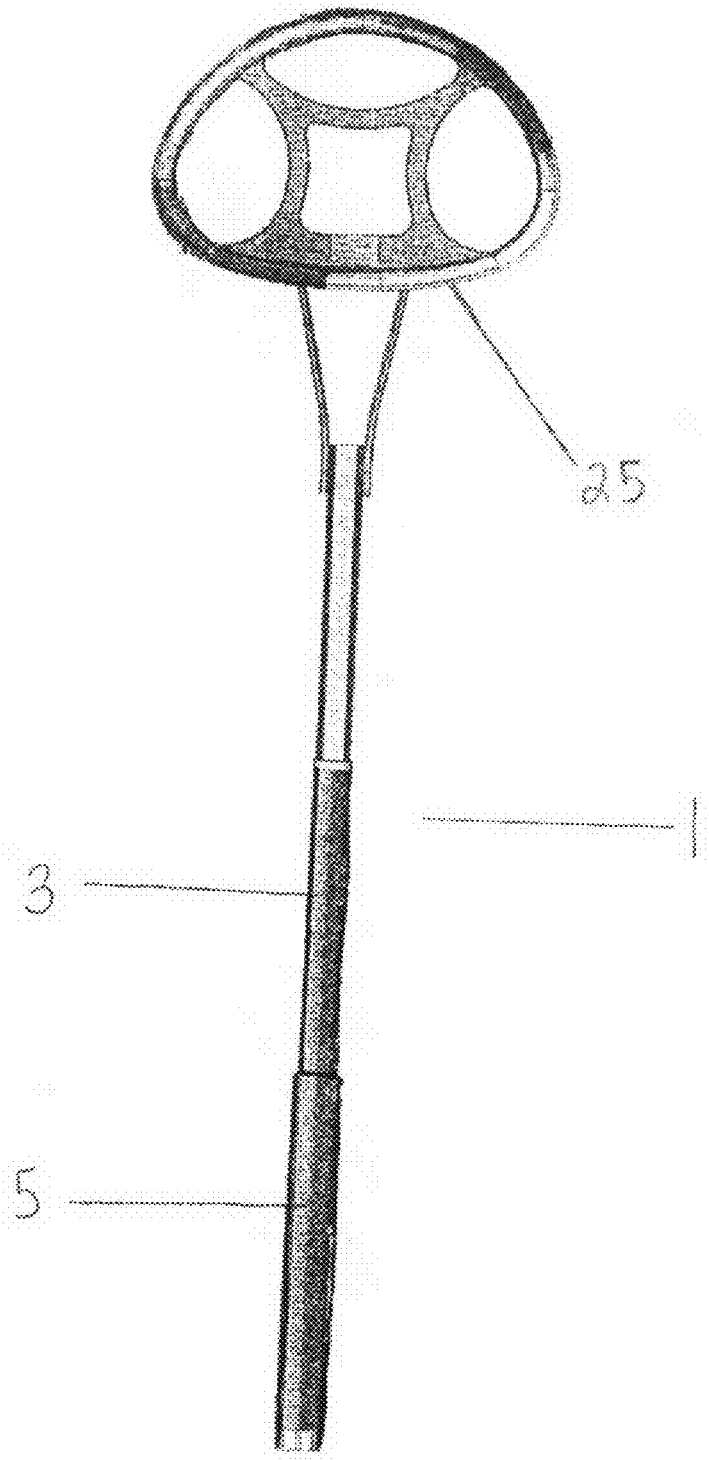
FIG. 16 shows a front-view of an embodiment of the present invention with a basketball backboard.
Figure 17:
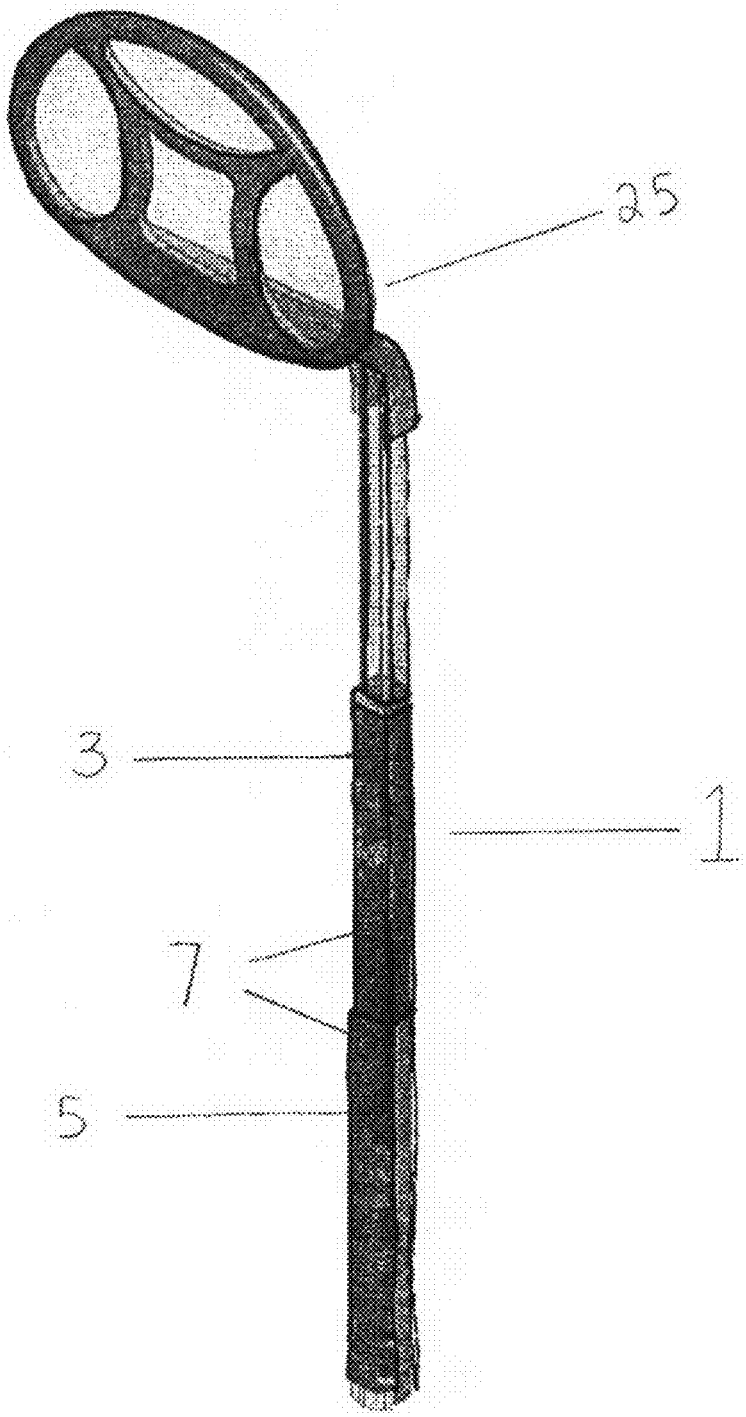
FIG. 17 shows an angled-view of an embodiment of the present invention with a basketball backboard.
Figure 18:
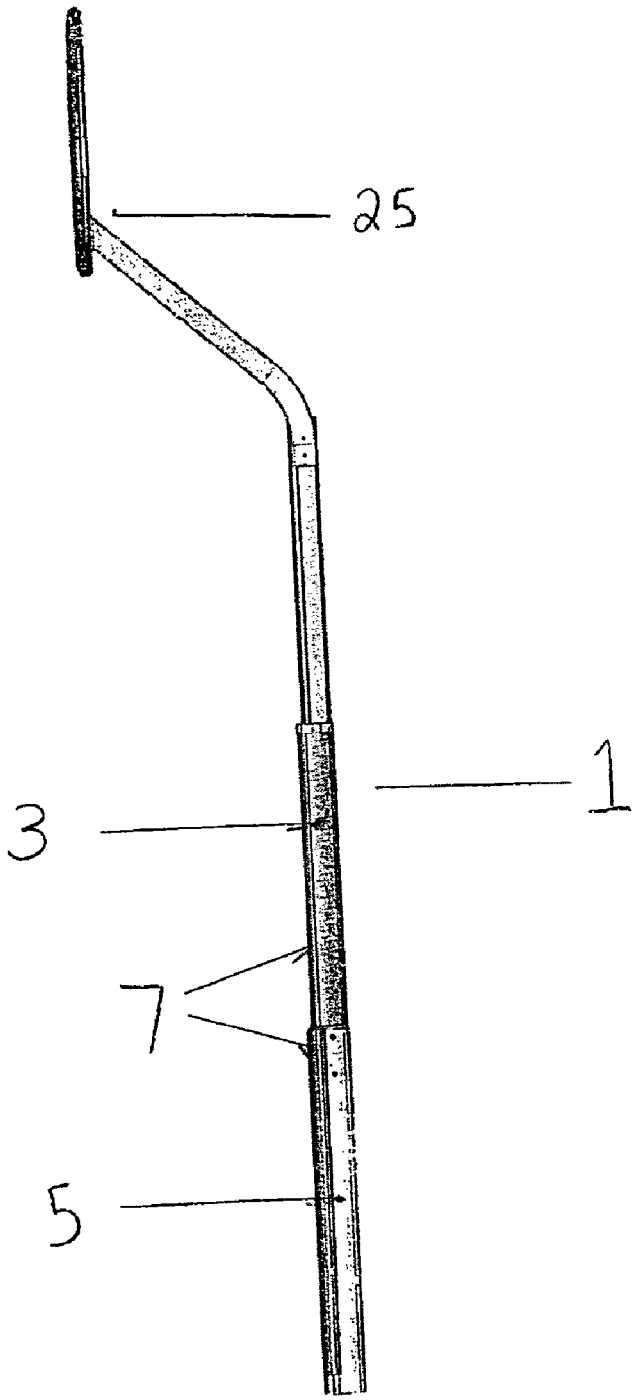
FIG. 18 shows a side-view of an embodiment of the present invention with a basketball backboard.

FIGS. 12 and 13 show embodiments of the present invention with an embodiment of the elevator mechanism 15. As can be seen in these figures, the elevator mechanism 15 may comprise handle 13. Handle 13 may be attached to worm gear 17. Worm gear 17 may be attached to spur gear 19. Spur gear 19 may be attached to pinion 21. Pinion 21 may be attached to rack 23. As handle 13 rotates, it may, in turn, rotate worm gear 17. Worm gear 17 may then rotate spur gear 19, which may turn pinion 21. As pinion 21 rotates, it may move rack 23 linearly upward or downward. As rack 23 moves upward or downward, tube member components may be raised or lowered, thus adjusting the height of any basketball hoop attached to hoop bracket 11 (not shown in FIGS. 12 and 13) above the playing surface.

As noted above, in some embodiments, some tube member components may reside within another when packaged. In some of these embodiments, rack 23 may be attached to the inner-most tube member component stored within the other tube member components. When the present invention is in the raised position in order to play a sports game, the inner-most tube member is the top tube member component. To extend such an embodiment of the present invention to the desired height above the playing surface, rack 23 may be moved upward, which may force the inner-most tube member upward. As the tube member component is raised above the playing surface, catches located along the outside bottom edge of the inner-most tube member may engage the next tube member component along the inner upper edge of the next component tube member. The next component tube member is thus raised and, in turn catches located along its outside bottom edge may engage the next tube component tube member. This may continue until the pole has been extended to a desired height above the playing surface for game play.

In some embodiments, it may be possible to disconnect handle 13 from the elevator mechanism 15. This may be done to securely store handle 13 and/or conveniently pack/store handle 13 during game play or for shipping and transport while ensuring that the support structure does not have any dangerous protrusions. In some embodiments, handle 13 may include a hinge located near the tube member. By folding the hinge, handle 13 may fit inside a cavity formed in a tube member component or the main tube member. In this way, handle 13 may remain attached but conveniently stored without any dangerous protrusions.

Figure 20:
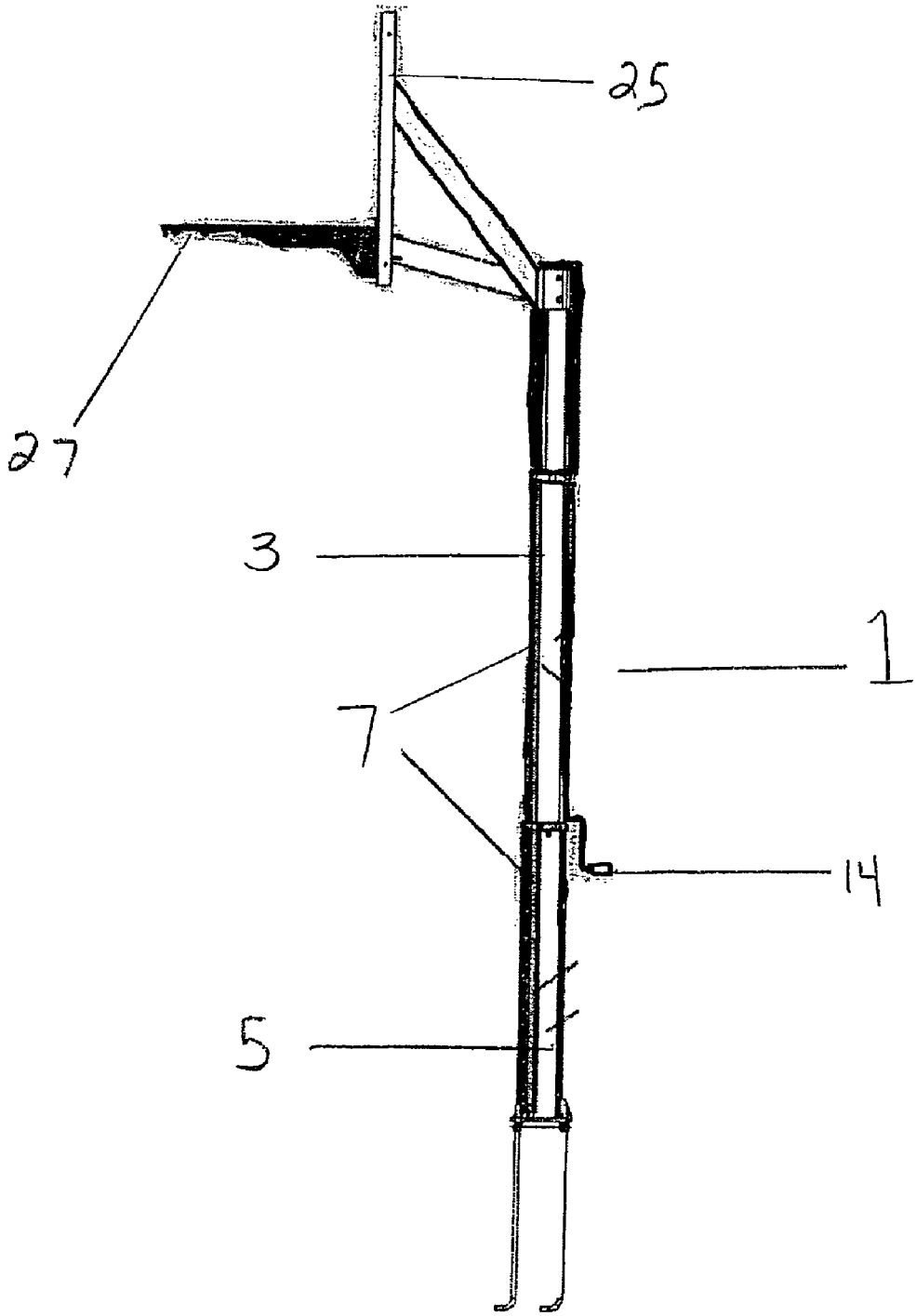
FIG. 20 shows a side-view of an embodiment of the present invention with a backboard and basketball goal.
Figure 21:
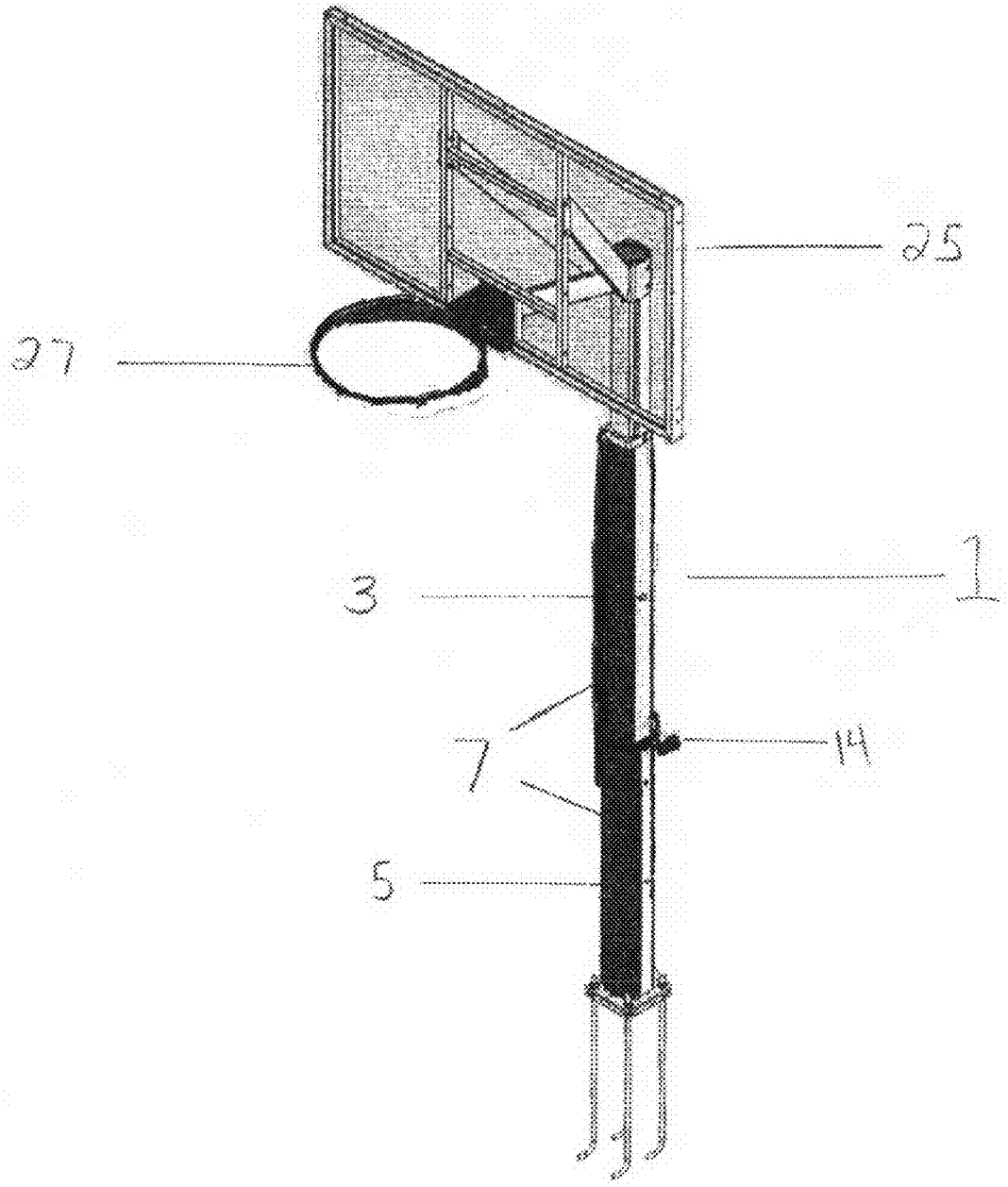
FIG. 21 shows an angled-view of an embodiment of the present invention with a backboard and basketball goal.

FIGS. 14, 15, 16, 17, and 18 show an embodiment of the present invention with a backboard assembly 25. In such an embodiment, a backboard assembly may be attached to the top of main tube member 1 (which may also be the top of tube member component 3 in some embodiments). In such an embodiment, the backboard assembly may be attached to the top of the tube member via its own structure, as depicted in the figures, or it may be attached to a hoop bracket 11. FIGS. 20 and 21 show an embodiment of the present invention with a backboard assembly 25 and a basketball goal 27.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A basketball assembly, comprising:

a backboard and goal;

a support pole having an exterior surface, a first end and a second end, the first and being attached to said backboard and goal;

at least one pad attachment having a first and second surface, said at least one pad attachment being coupled to at least a portion of said support pole, such that a portion of the exterior surface of said support pole and a portion of the first surface of said at least one pad attachment form a substantially smooth and continuous exterior surface wherein at least one pad attachment is coupled to at least a portion of said support pole by at least one mechanical fastener positioned on the second surface of said pad attachment and wherein said fastener comprises at least one tab and at least one slot, wherein the tab comprises at least one protrusion and the slot comprises at least one opening for receiving said tab.

2. The assembly of claim 1, wherein said support pole comprises a plurality of hollow tube components and at least one pad attachment is coupled to at least a portion of one of the plurality of hollow tube components.

3. The assembly of claim 2, wherein one of the plurality of hollow tube components has an interior diameter configured to telescopically receive at least one other hollow tube component.

4. The assembly of claim 3, further comprising an elevator mechanism configured to raise or lower the height of said backboard and goal above a playing surface.

5. The assembly of claim 2, wherein at least one pad attachment is coupled to at least a portion of said support pole by at least one mechanical fastener positioned on the second surface of said pad attachment.

6. The assembly of claim 5, wherein said fastener comprises at least one tab and at least one slot, wherein the tab comprises at least one protrusion and the slot comprises at least one opening for receiving a tab.

7. The assembly of claim 2, wherein at least one of said plurality of hollow tube components is comprised of extruded aluminum.

8. The assembly of claim 2, wherein at least one of said plurality of hollow tube components is comprised of plastic.

9. The assembly of claim 1, wherein said support pole is comprised of extruded aluminum.

10. The assembly of claim 1, wherein said support pole is comprised of plastic.

* * * * *